US005135422A

United States Patent [19]

Bowen

[11] Patent Number: 5,135,422

[45] Date of Patent: Aug. 4, 1992

[54] BUBBLE WAND

[76] Inventor: Joseph Bowen, 202 Watchung Ave., Upper Montclair, N.J. 07043

[21] Appl. No.: 738,126

[22] Filed: Jul. 30, 1991

[51] Int. Cl.[5] ..... A63H 33/28
[52] U.S. Cl. ..... 446/15
[58] Field of Search ..... 446/15, 19, 17

[56] References Cited

U.S. PATENT DOCUMENTS

| | | | |
|---|---|---|---|
| 534,277 | 2/1895 | Montgomery et al. | 446/19 |
| 2,514,009 | 7/1950 | Raspet | 446/15 |
| 2,720,723 | 10/1955 | Peretti | 446/15 |
| 2,928,205 | 3/1960 | Fulton | 446/15 |
| 3,064,387 | 11/1962 | Campbell | 446/15 |
| 4,152,864 | 5/1979 | Habisohn | 446/15 |
| 4,180,938 | 1/1980 | La Fata et al. | 446/15 |
| 4,654,017 | 3/1987 | Stein | 446/15 |
| 4,790,787 | 12/1988 | Rector | 446/15 |
| 4,808,138 | 2/1989 | Von Braunhut | 446/16 |
| 4,934,255 | 7/1990 | Klundt | 446/15 |

FOREIGN PATENT DOCUMENTS

| | | | |
|---|---|---|---|
| 1413175 | 12/1965 | France | 446/15 |

OTHER PUBLICATIONS

"Sleeping Beauty Magic Bubble Wand", PLAY-THINGS, p. 24, Mar. 1959.

*Primary Examiner*—Mickey Yu
*Attorney, Agent, or Firm*—Anthony J. Casella; Gerald E. Hespos

[57] ABSTRACT

A bubble wand toy is provided for use with a soap solution. The bubble wand toy includes a tubular handle formed from a substantially rigid tubular plastic. A flexible tubular material is bent into a loop and the opposed ends of the loop are inserted into an end of the tubular handle. The relative dimensions of the flexible tubular loop and the tubular handle are such that the opposed ends of the tubular loop are frictionally retained in the tubular handle. An adhesive or sealant may be disposed at the interface of the tubular loop and the tubular handle to retain the tubular loop and handle together and to prevent a flow of soap solution through the tubular handle. An outer collar may be disposed over the tubular handle generally at the interface of the loop and the handle to prevent a flow of soap solution along the outside of the tubular handle. A closure may be disposed at the opposed end of the tubular handle and a flanged collar may be disposed over the tubular handle intermediate its length to further prevent a flow of soap solution along the length of the handle.

8 Claims, 3 Drawing Sheets

BUBBLE WAND

BACKGROUND OF THE INVENTION

Bubble wand toys have been enjoyed by children throughout the world from one generation to the next. In its simplest form, the bubble wand toy consists of a small ring which can be placed into a jar of soap solution. The soap solution forms a continuous film across the ring when the ring is withdrawn from the jar. If the child then moved the wand through the air or blows gently on the film, a portion of the soap film forms into a bubble that gently floats through the air for several seconds.

Bubble wands traditionally have been very small, with a ring of about one inch in diameter and a handle of a few inches extending from the ring. The prior art bubble wand typically has been sold with a jar of soap solution. The child would merely grip the handle of the bubble wand with one hand and dip the ring into the jar of soap solution. A typical prior art bubble wand of this type is shown in U.S. Pat. No. 2,514,009 which issued to Raspet on Jul. 4, 1950.

The prior art has included many variations of the above described bubble wand. For example, the prior art has included many toys where the bubble forming ring is an integral part of a supply of soap solution. For example, U.S. Pat. No. 2,720,723 which issued to Peretti on Oct. 18, 1955 shows a bubble wand apparatus that is integral to the cap on a bottle of soap solution. The bubble wand apparatus includes at least one tube extending through the cap for delivering a supply of the soap solution from the bottle. The ring is defined by a wire and is inserted into the tube extending from the bottle cap. A flap also extends from the cap and is mounted adjacent to the ring. The child using the toy shown in U.S. Pat. No. 2,720,723 inverts the bottle to cause some of the soap solution therein to flow through the tube and to spread across the entire periphery of the wire ring. The child then agitates the entire assembly to cause a relative movement between the flap and the ring that generates a flow of bubbles.

U.S. Pat. No. 3,064,387 issued to Campbell on Nov. 20, 1962 and shows an elongated tube bent into a circular ring at one end. The ring includes a complex array of apertures and defines a distributor head for dispensing a soap solution that is transported through the tube. The opposed end of the tube is connected to a supply of the bubble solution, such as a compressible bulb. The soap solution transported through the tube to the distributor head is intended to produce a film across the ring that can generate a stream of bubbles by either waving the entire wand or placing the wand out the window of a moving vehicle.

U.S. Pat. No. 4,180,938 issued to LaFata on Jan. 1, 1980 and shows a bubble wand for use with a spill-proof container.

The prior art also includes bubble toys intended to make very large bubbles. For example, French patent No. 1,413,175 which issued on Dec. 31, 1965 shows the combination of a pan for receiving a supply of soap solution and a large molded ring and handle dimensioned for dipping into the pan of soap solution. Although bubble toys of this type can be very effective in creating fairly large bubbles, the molded bubble wand is costly to make and is very fragile. Breakage is likely if the child inadvertently contacts an object while waving the ring. Furthermore, once broken the wand is virtually impossible to repair. A larger sturdier molded ring would be less likely to break. However, a child waving a large sturdy ring could easily injure another child playing nearby. Additionally, a fairly large ring as shown in French Patent No. 1,413,175 accumulates a fairly significant amount of soap solution. The soap solution tends to run down the handle and makes the handle very sloppy and slippery. The very slippery soap solution can cause the wand to slip out of the child's hand, and the fragile ring can break upon falling.

Other toys for making large bubbles have relied upon rigid rods with string or ribbons looped therefrom. For example, U.S. Pat. No. 2,928,205 which issued Fulton on Mar. 15, 1960 shows a bubble toy comprising a rod and a ribbon looped relative to the rod. The ribbon can be collapsed to one end of the rod and dipped into a large supply of soap solution. The rod and ribbon is then withdrawn from the soap solution and the ribbon is allowed to droop into a generally ring-shaped configuration. The rod and ribbon are the waved to create a bubble in much the same manner as the conventional smaller bubble wand. A similar toy is shown in U.S. Pat. No. 4,654,017 which issued to Stein on Mar. 31, 1987. Bubble devices of this type require a level of coordination and manipulation that is difficult for a young child to achieve. The rigid rod can be a virtual weapon in the hands of a young child attempting to create a bubble, and injury to a nearby child is likely. Furthermore, the rod of these prior art bubble devices can become very sloppy due to the flow of soap solution down the handle as the rod is employed. An even more complex apparatus of this general type is shown in U.S. Pat. No. 4,943,255 which issued to Clundt on Jul. 24, 1990. The apparatus shown in U.S. Pat. No. 4,943,255 includes two rods and a flexible string, and hence would even be more difficult for a young child to employ.

U.S. Pat. No. 4,808,138 shows a very complex apparatus employing a pair of longitudinally extending strings which are connected by a pair of spaced apart transverse strings. The longitudinally extending strings are connected at one end to a handle and at their opposed end to a roll. The roll is mounted in a container and is biased to roll the longitudinally extending strings thereabout. The container is adapted to store a supply of soap solution. It is intended that the handle may be pulled to unwind the longitudinally extending strings from the roll. It is further intended that a film of soap solution will be formed across the area defined by the longitudinally extending strings and the transverse strings. The entire apparatus may then be moved to generate a bubble. This apparatus is very complex and also would be difficult for a young child to employ. Furthermore, both the handle and the container are likely to become very sloppy due to soap solution that is generated when a bubble breaks.

In view of the above, it is an object of the subject invention to provide a toy for making very large bubbles.

It is another object of the subject invention to provide a toy that can be used easily by a young child.

A further object of the subject invention is to provide a bubble wand of rigid construction for long term use by a young child.

An additional object of the subject invention is to provide a bubble wand that substantially avoids an accumulation of soap material on the handle.

Still a further object of the subject invention is to provide a bubble wand that can be used with a variety of available household receptacles, such as pie pans, cake pans and the like.

Still a additional object of the subject invention is to provide a bubble wand that can be manufactured from readily available stock materials.

Yet a further object of the subject invention is to provide an efficient method for manufacturing a bubble wand.

Another object of the subject invention is to provide a large bubble wand that is very safe to use.

SUMMARY OF THE INVENTION

The subject invention is directed to a bubble wand having a flexible loop for receiving a film of soap solution and a substantially rigid handle extending from the flexible loop. The flexible loop may be formed from a flexible tubular member, that will yield upon contact, but that will retain a loop shape. The handle may be formed from a substantially rigid tubular member. The tubular handle may define an inside diameter dimensioned to frictionally retain opposed ends of the flexible loop of the bubble wand. More particularly, a length of the flexible material may be looped such that the opposed ends thereof are in substantially side-to-side relationship. The side-by-side ends of the loop may then be slightly deformed and forcibly urged into one end of the substantially rigid tubing to define a loop extending from the tubular handle. An adhesive or sealant may be disposed intermediate the ends of the flexible loop and the inside of the end of the substantially rigid tube to securely retain the flexible tube within the rigid tubular handle, and to seal the interface between the loop and the tubular handle.

The area of the tubular handle adjacent the loop may be provided with a short section of outer tubing. The outer tubing may have an inside diameter approximately equal to the outside diameter of the tubular handle. Thus, the outer tube may be frictionally retained over the tubular handle. The outer tube defines a substantial discontinuity adjacent to the loop and reduces the amount of soap solution flowing down the tubular handle. In particular, the outer tube will cause excess soap solution to drip substantially at the interface of the tubular handle, the outer tube and the loop, rather than flowing longitudinally along the handle.

The tubular handle may further include a bottom closure engaged with the end of the tubular handle remote from the loop. The bottom closure may define a plug insertable into the end of the tubular handle or a cap telescoped over the end of the tubular handle. The closure may be adhesively secured in place. The closure can perform several functions. First, any soap solution that may migrate through the handle will be prevented from spilling onto the child using the bubble wand. Second, unsightly dirt or debris will be prevented from accumulating inside the tubular handle. Third, the closure can enable an aesthetically attractive material to be stored within the handle tube.

The bubble wand may further include a collar disposed intermediate its length to further prevent a flowing of soap solution into the area of the tubular handle gripped by the child. The collar may include a cylindrical portion dimensioned to closely engage the outer circumference of the tubular handle and a flange extending outwardly from the cylindrical portion. The collar may be either frictionally retained on the handle or adhesively secured in a selected position thereon.

DETAILED DESCRIPTION OF THE PREFERRED EMBODIMENTS

Figure 6:
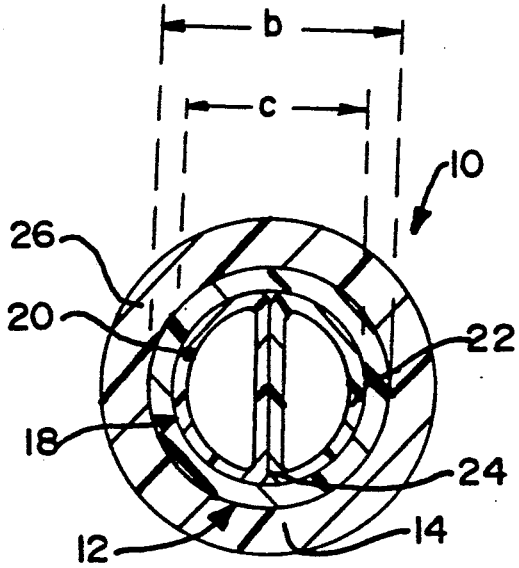
FIG. 6 is a cross-sectional view taken along line 6—6 in FIG. 2.

A bubble wand in accordance with the subject invention is identified generally by the numeral 10 in FIGS. 1–6. The bubble wand 10 comprises an elongated plastic tubular handle 12 having opposed first and second ends 14 and 16. The tubular handle 12 defines a length "a" which preferably is about 12–24 inches. This length has been found to enable a child to access a supply of soap solution stored on the ground and to enable efficient manipulation by the child. The tubular handle 12 defines an outside diameter "b" and an inside diameter "c" as shown in FIG. 6. The tubular handle 12 preferably is formed from a substantially rigid plastic material. However, the plastic material of the tubular handle 12 preferably is not brittle and may exhibit some flexure.

Figure 2:
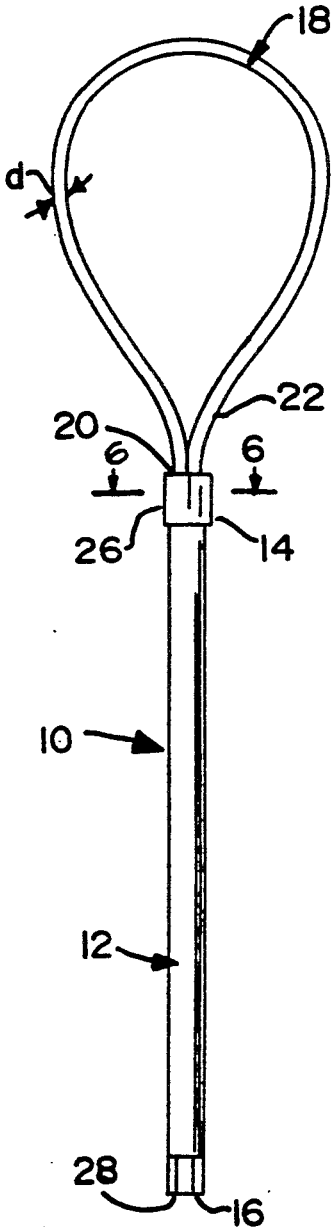
FIG. 2 is a front elevational view of the bubble wand shown in FIG. 1.
Figure 3:
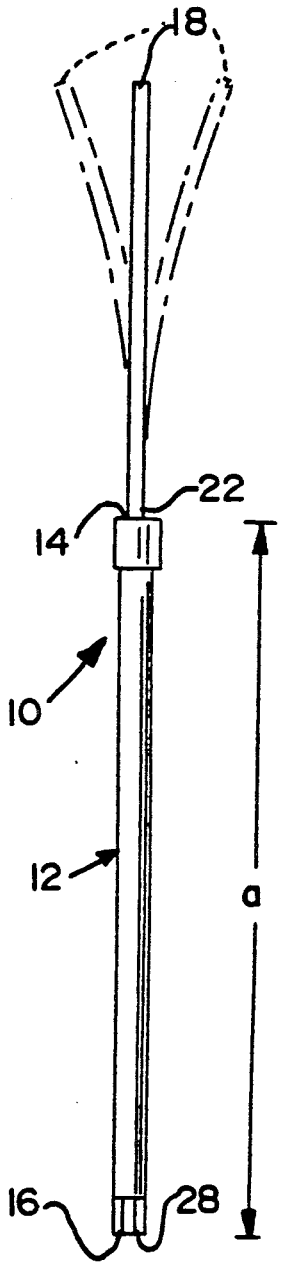
FIG. 3 is a side elevational view of the bubble wand.
Figure 4:
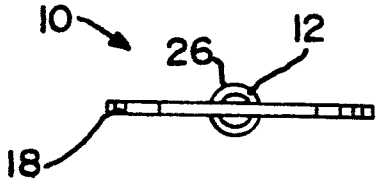
FIG. 4 is a top plan view of the bubble wand.
Figure 5:
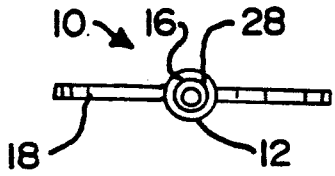
FIG. 5 is a bottom plan view of the bubble wand.

The bubble wand 10 further includes a loop 18 formed from a flexible tubing that exhibits sufficient stiffness to retain its looped configuration. The flexible tubing of the loop 18 includes a pair of opposed ends 20 and 22. The flexible tubular material of the loop 18 defines an outer diameter "d" as shown in FIG. 2. The diameter "d" selected such that twice the diameter "d" exceeds the inside diameter "c" of the tubular handle 12. The opposed ends 20 and 22 of the loop 18 are positioned in side by side relationship and are deformed slightly and squeezed into the first end 114 of the tubular handle 12. The relative dimensions of the outside diameter "d" of the flexible tubing of the loop 18 and the inside diameter "c" of the tubular handle 12 ensures that the opposed ends 20 and 22 of the loop 18 will be frictionally retained inside the tubular handle 12 as shown in FIG. 6. More particularly, the ends 20 and 22 of the loop 18 are compressed and/or cross-sectionally deformed into substantially D-shaped configurations for tight fitting within the first end 14 of the tubular handle 12. The flexible tubular material from which the loop 18 is formed is resilient. Hence, the compression of the flexible tubular material that is required to squeeze the ends 20 and 22 into the tubular handle 12 causes the ends 20 and 22 to exert outward forces on the end 14 of the tubular handle tube 12 as the tubular loop 18 tries to resiliently return towards an uncompressed condition. The tight interfitting and the resilient outward forces serve to securely hold the ends 20 and 22 of the loop 18 in first end 14 of the handle tube 12. As shown in FIG. 6, however, the retention of the ends 20 and 22 of the loop 18 in the first end of the handle tube 12 may be enhanced by an adhesive or sealant 24. In addition to enhancing the retention of the loop 18 to the tubular handle 12, the sealant or adhesive 24 prevents a flowing of soap solution into the tubular handle 12.

The bubble wand 10 is further provided with an outer collar 26 disposed over the tubular handle 12 in proximity to the first end 14 thereof. The outer collar 26 is also formed from a tubular material which preferably exhibits greater flexibility than the substantially rigid tubular handle 12. In particular, the outer collar 26 is formed from a tubular material having an inside diameter "b" substantially equal to the outside diameter of the tubular handle 12. Thus, the somewhat flexible outer collar 26 can be frictionally retained over the tubular handle 12 in proximity to the first end 14 thereof. The outer collar preferably defines an axially length in a range of 1.0–2.0 inches. The outer collar 26 performs two functions. First, the outer collar 26 substantially increases the cross-sectional discontinuity at the interface of the loop 18 and the handle 12. This increase in discontinuity substantially reduces the likelihoods of soap solution running along the length of the handle 12. Second, the outer collar 26 provides a reinforcement to the first end 14 of the tubular handle 12. Consequently, damage to the first end 14 of the tubular handle 12 will not occur during assembly of the components nor during use of the bubble wand 10. In this regard, the first end 14 of the handle 12 often will inadvertently be brought into contact with another object by the child swinging the wand in an effort to generate a bubble. The somewhat resilient outer collar 26 protects the first end 14 of the tubular handle 12 from such contact by functioning as a shock absorber.

The bubble wand 10 further includes a closure 28 at the second end 16 of the tubular handle 12. As shown in FIGS. 1–6, the closure 28 defines a stopper frictionally inserted into the second end 16 of the tubular handle 12 for preventing accumulation of debris. The stopper 28 preferably is adhered in position to prevent accidental disengagement. In an alternate embodiment, as shown in FIG. 7, the bubble wand 10′ is provided with a cap 28′ that is telescoped over the second end 16′ of the tubular handle 12′.

Figure 7:
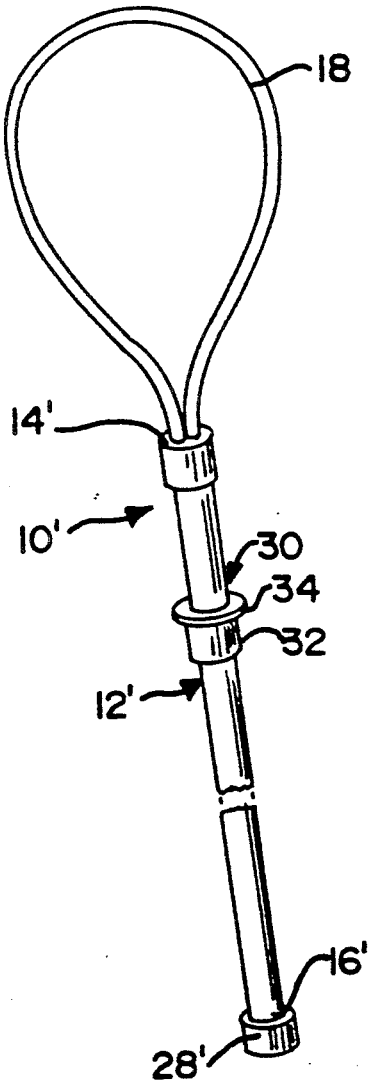
FIG. 7 is a perspective view of an alternate embodiment of the bubble wand.

With further reference to FIG. 7, the alternate bubble wand 10′ is further provided with a flanged collar 30 intermediate the opposed ends 14′ and 16′ thereof. The flanged collar includes a generally cylindrical portion 32 having an inside diameter dimensioned to frictionally retain the outer circumference of the tubular handle 12′. The cylindrical portion 32 may further be adhesively secured at a selected location along the length of the tubular handle 12 prime. The flanged collar 30 further includes an outwardly extending flange 34 at one end of the cylindrical portion 32 thereof. The flanged collar 30 prevents a flow of soap solution into the area of the tubular handle 12′ that will be gripped by a child during use. Additionally, the flanged collar 30 further defines the location to be gripped by the young child.

Figure 1:
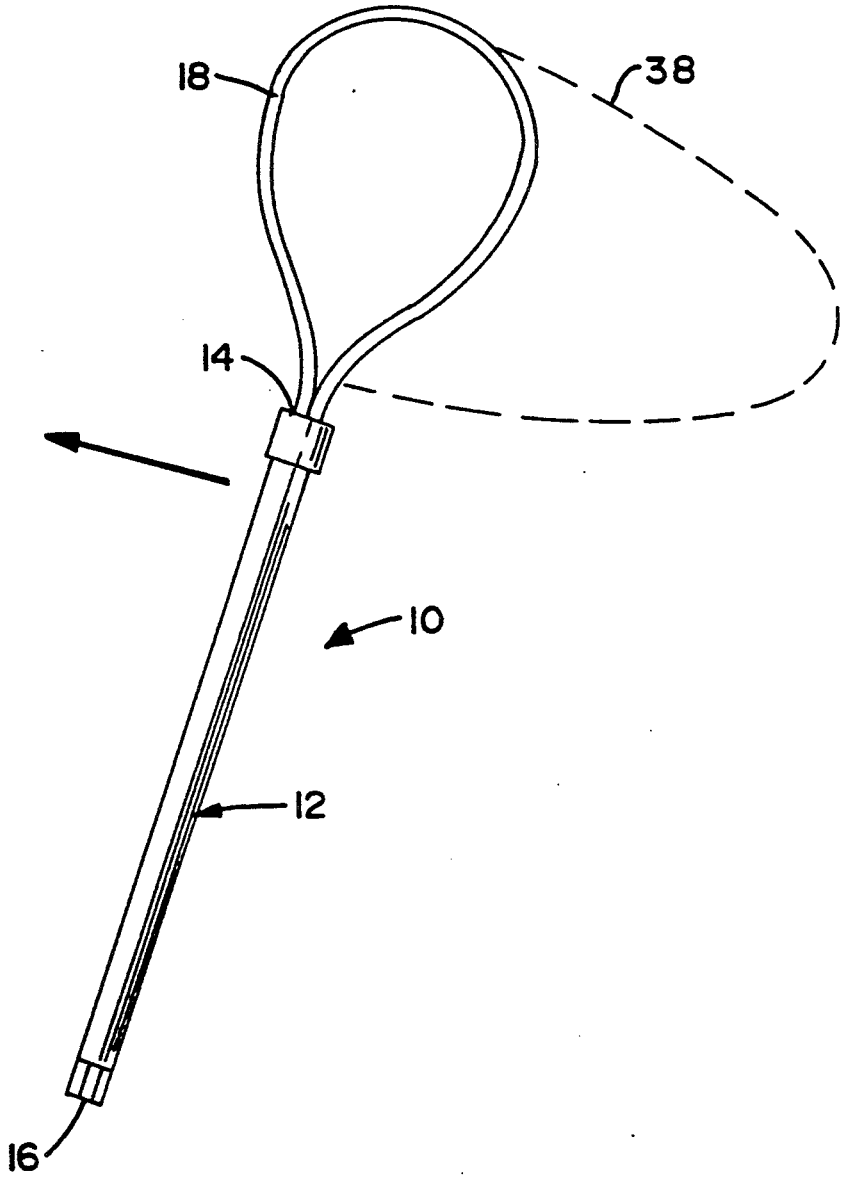
FIG. 1 is a perspective view of a bubble wand in accordance with the subject invention.
Figure 8:
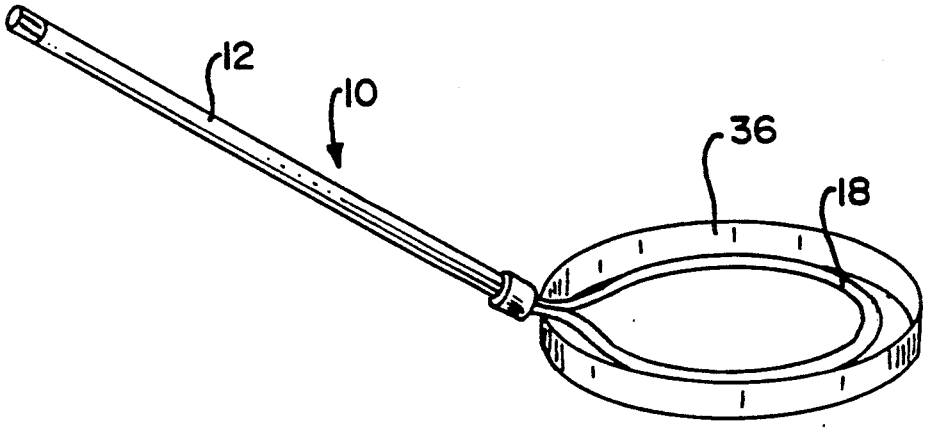
FIG. 8 is a perspective view of the bubble wand used with a receptacle for soap solution.

The bubble wand 10 is employed as shown in FIGS. 8 and 1. More particularly, the bubble wand 10 may be used with a generally flat receptacle 36 into which a soap solution may be poured. The receptacle 36 may be a specially manufactured receptacle for sale and use with the bubble wand 10. However, a conventional pie pan, cake pan, trash can cover or deep dish may be employed. The flexible characteristics of the loop 18 facilitate any deformation that may be needed for efficient submersion of the loop 18 into the soap solution stored in the receptacle 36 The child need merely withdraw the bubble wand 10 from the receptacle 36 and wave the bubble wand 10 by the tubular handle 12 as depicted generally in FIG. 1. The movement of the loop 18 relative to the surrounding atmosphere will cause the generation of a bubble 38.

The bubble wand 10 illustrated above has several significant advantages. First, the plastic tubular material from which the handle 12 and the loop 18 are formed are very sturdy and sufficiently indestructible for use by a child. Second, the bubble wand 10 is very safe in use. In this regard, the end of the bubble wand 10 defined by the loop 18 is flexible and hence injury is extremely unlikely if one child were to impact another child with this moving end of the bubble wand 10. The bubble wand 10 as described above also is very neat for the child to use as compared to other toys of this type. In particular, the outer collar 26 and/or the flanged collar 30 prevent a flow of soap solution along the outside of the tubular handle 12 of the bubble wand 10. Additionally, the adhesive or sealant 24 that may be used to hold the loop 18 to the tubular handle 12 and the closure at the second end 16 of the tubular handle 12 substantially prevent soap solution from flowing internally through the length of the tubular handle 12.

While the invention has been described with respect to certain preferred embodiments, it is apparent that various changes can be made without departing from the scope of the invention as defined by the appended claims.

I claim:

1. A bubble wand comprising:

a tubular handle formed from a substantially rigid plastic material and having opposed first and second ends, an inside diameter and outside diameter;

a bubble-forming loop formed from a flexible and cross-sectionally deformable plastic tubular material having opposed first and second ends, the first and second ends of the flexible cross-sectionally deformable tubular material being disposed in adjacent side by side relationship and being positioned inside the first end of the tubular handle, the cross-sectional dimensions of the flexible tubular material being selected to require cross-sectional deformation of the first and second ends thereof for insertion into the tubular handle;

a sealant disposed intermediate the first and second ends of the flexible loop and the first end of the tubular handle for preventing a flow of soap solution into the tubular handle;

an outer collar formed from a tubular material having an inside diameter no greater than the outside diameter of the tubular handle, the outer collar being frictionally retained over the first end of the tubular handle for strengthening the first end of the tubular handle and minimizing flow of soap solution along the tubular handle;

an intermediate collar securely mounted over the tubular handle intermediate the first and second ends thereof for further minimizing flow of soap solution along the tubular handle; and a closure engaged with the second end of the tubular handle for preventing a flow of soap solution from the tubular handle, whereby the flexible loop can be emersed in a soap solution for developing a bubble producing film thereacross, and whereby the flexible loop substantially prevents injury or damage due to contact therewith.

2. A bubble wand as in claim 1, wherein the sealant is an adhesive.

3. A bubble wand as in claim 1, wherein the outer collar is formed from a substantially flexible tubular material having an inside diameter substantially equal to the outer diameter of the tubular handle.

4. A bubble wand as in claim 1, wherein the outer collar defines a length of between 1.0 and 2.0 inches.

5. A bubble wand as in claim 1, wherein the closure defines a plug inserted into the second end of the tubular handle.

6. A bubble wand as in claim 1 wherein the intermediate collar includes an outwardly extending flange for preventing a flow of soap solution entirely along the tubular handle of the bubble wand.

7. A bubble wand as in claim 1 wherein the closure on the second end of the tubular handle is a cap telescoped over the second end of the tubular handle.

8. A method for making a bubble wand comprising:

providing a substantially rigid tubular member having opposed first and second ends, an inside diameter and an outside diameter;

providing an outer collar formed from a tubular material having an inside diameter substantially equal to the outside diameter of the tubular handle;

providing a closure dimensioned to engage the second end of the tubular handle;

providing a length of flexible tubular material having opposed first and second ends, the flexible tubular material defining an outside diameter equal to at least one half the inside diameter of the tubular handle;

frictionally retaining the outer collar over the first end of the tubular handle for reinforcing the first end of the tubular handle and substantially preventing flow of soap solution along the tubular handle;

securely affixing the closure to the second end of the tubular handle for preventing a flow of soap solution through the tubular handle and for preventing accumulation of debris within the tubular handle;

positioning the first and second ends of the flexible tubular material in side by side relationship to one another;

compressing the first and second ends of the flexible tubular material and urging the first and second ends of the flexible tubular material into the first end of the tubular handle for defining a flexible loop extending from the first end of the tubular handle; and inserting a sealant intermediate the first and second ends of the flexible tubular material and the tubular handle.

* * * * *